US007276321B2

(12) United States Patent
Hohner et al.

(10) Patent No.: US 7,276,321 B2
(45) Date of Patent: Oct. 2, 2007

(54) USE OF WAX-LIKE COMPOUNDS IN PHOTO TONER

(75) Inventors: Gerd Hohner, Gersthofen (DE); Michael Bayer, Thierhaupten (DE)

(73) Assignee: Clariant Produkte (Deutschland) GmbH, Sulzbah (DE)

( * ) Notice: Subject to any disclaimer, the term of this patent is extended or adjusted under 35 U.S.C. 154(b) by 358 days.

(21) Appl. No.: 10/515,397

(22) PCT Filed: May 20, 2003

(86) PCT No.: PCT/EP03/05448

§ 371 (c)(1),
(2), (4) Date: Nov. 19, 2004

(87) PCT Pub. No.: WO03/100526

PCT Pub. Date: Dec. 4, 2003

(65) Prior Publication Data

US 2005/0147907 A1 Jul. 7, 2005

(30) Foreign Application Priority Data

May 29, 2002 (DE) ..... 102 23 785

(51) Int. Cl.
*G03G 9/08* (2006.01)

(52) U.S. Cl. ..... 430/108.4

(58) Field of Classification Search ..... 430/108.4
See application file for complete search history.

(56) References Cited

U.S. PATENT DOCUMENTS

| | | | |
|---|---|---|---|
| 5,164,436 | A | 11/1992 | Maier et al. |
| 5,635,325 | A | 6/1997 | Inaba et al. |
| 5,998,080 | A | 12/1999 | Ohno et al. |
| 6,492,084 | B2 | 12/2002 | Tomita |
| 6,653,039 | B2 | 11/2003 | Tomita |
| 2001/0051310 | A1 | 12/2001 | Tomita |
| 2002/0136974 | A1 | 9/2002 | Nakamura et al. |
| 2003/0031947 | A1 | 2/2003 | Tomita |
| 2003/0039911 | A1 | 2/2003 | Tomita |

FOREIGN PATENT DOCUMENTS

| | | |
|---|---|---|
| EP | 0291872 | 11/1988 |
| EP | 0686880 | 12/1995 |
| EP | 0899617 | 3/1999 |
| EP | 1152297 | 11/2001 |
| EP | 1199608 | 4/2002 |
| EP | 1280013 | 1/2003 |

OTHER PUBLICATIONS

PCT International Search Report for Corresponding application PCT/EP03/05448, mailed Oct. 15, 2003.
PCT IPER for PCT/EP03/05448, Dec. 15, 2003 PCT/EP03/05448, mailed Oct. 15, 2003.
English Translation of PCT IPER for PCT/EP03/05448, Dec. 15, 2003.
English abstract for JP 2002023411; Jan. 23, 2002.
English abstract for JP 2003035971; Feb. 7, 2003.
English abstract for JP 2003035972; Feb. 7, 2003.

*Primary Examiner*—Christopher Rodee
(74) *Attorney, Agent, or Firm*—Anthony A. Bisulca

(57) ABSTRACT

Photo toners including a wax-like compound of the formula (I), detailed in the specification. In formula (I), $R^1$ represents the group —$CH_2$—O—CO—$R^3$ or CH(OH)—$CH_2$—O—CO—$R^3$, $R^2$ represents an alkyl radical comprising between 1 and 4 C atoms or halogen, $R^3$ represents an unbranched alkyl radical comprising between 16 and 36 C atoms, m is 1, 2 or 3, and n is between 0 and (6–m).

4 Claims, No Drawings

USE OF WAX-LIKE COMPOUNDS IN PHOTO TONER

The present invention relates to the use of wax-like compounds containing aromatic units in photo toners and also photo toners comprising such compounds.

Photo toners comprising resins, pigments, charge control agents and waxes and also, if desired, flow improvers are customarily used in modern copying processes. In the copying procedure, the pulverulent photo toners usually firstly form an image of the item to be copied on a transfer roller and are from there transferred to the copying paper and subsequently subjected to thermal fixing.

The waxes present as formulation component in the toner act as release and anti-offset agents to aid detachment of the photo toner from the fixing roller, act as coupling agents in transfer to the paper and, in the preparation of the toner, act as dispersants and thus contribute to homogeneous distribution of the pigments.

The demand for ever faster copiers requires correspondingly quick-responding toner systems and places severe demands on the individual components of the toner formulation.

As wax components in photo toners, use has hitherto been made predominantly of hydrocarbon waxes such as polyethylene or polypropylene waxes. These waxes do not meet the requirements of modern fast-running copying machines in all aspects. In particular, there is a need for wax components having improved anti-offset action, an improved action in respect of adhesion of the printing to the paper and further-optimized pigment-dispersing properties.

EP 0 291 872 A1 describes wax-like esters of aromatic alcohols and their use as lubricants for highly transparent thermoplastic polymers.

It has now surprisingly been found that such polar, wax-like compounds containing aromatic groups are particularly useful as additives for photo toners. In particular, such waxes achieve homogeneous dispersion of the pigment in the production of the toner and an improved anti-offset action and increased adhesion of the printing to the paper in the fixing process.

The invention accordingly provides for the use of wax-like compounds of the formula (I)

(I)

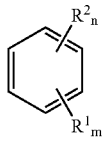

in photo toners, where $R^1$ is the group $—CH_2—O—CO—R^3$ or $—CH(OH)—CH_2—O—CO—R^3$, $R^2$ is an alkyl radical having from 1 to 4 carbon atoms or halogen, $R^3$ is an unbranched alkyl radical having from 16 to 36 carbon atoms and m is 1, 2 or 3 and n is from 0 to (6−m).

In the formula (I), preference is given to R being the group $—CH_2—O—CO—R^3$, $R^2$ being an alkyl radical having from 1 to 4 carbon atoms or halogen, $R^3$ being an unbranched alkyl radical having from 16 to 36 carbon atoms and m being 1, 2 or 3 and n being from 0 to (6−m).

The invention further provides photo toners comprising at least one pigment component, a resin component and a wax-like component of the formula (I) containing aromatic units.

The wax-like compounds of the formula (I) which can be used according to the invention are formed by reacting aromatic compounds of the formula (II)

(II)

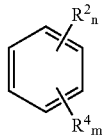

or the formula (III)

(III)

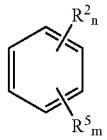

with the carboxylic acids of the formula (IV)

$R^3—COOH$ (IV).

In these formulae, $R^1$ is the group $—CH_2—O—CO—R^3$ or $—CH(OH)—CH_2—O—CO—R^3$, $R^2$ is an alky radical having from 1 to 4 carbon atoms or halogen, preferably an alkyl radical having from 1 to 2 carbon atoms or chlorine, $R^3$ is an unbranched alkyl radical having from 16 to 36 carbon atoms, preferably from 26 to 32 carbon atoms, $R^4$ is the group $—CH_2OH$ or $—CH(OH)—CH_2—OH$, preferably $—CH_2OH$, $R^5$ is the group

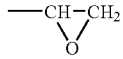

and m is 1, 2 or 3, preferably 1 or 2, and n is from 0 to (6−m), preferably from 0 to 3.

Suitable starting compounds of the formula (II) are, for example, benzyl alcohol, o-, m-, p-tolyl carbinol, chlorobenzyl alcohol, bromobenzyl alcohol, 2,4-dimethylbenzyl alcohol, 3,5-dimethylbenzyl alcohol, 3,4,5-trimethylbenzyl alcohol, p-cumine alcohol, 1,2-phthalyl alcohol, 1,3-bis(hydroxymethyl)benzene, 1,4-bis(hydroxymethyl)benzene.

An example of a suitable starting compound of the formula (III) is styrene oxide.

Suitable carboxylic acids of the formula (IV) are, for example, arachidic acid, behenic acid, tetracosanoic acid, cerotic acid, montanic acid, melissic acid, in particular technical-grade montanic acid which is essentially a mixture of $C_{18}$-$C_{36}$-carboxylic acids with a predominant proportion of $C_{26}$-$C_{32}$-carboxylic acids and is obtained by oxidative bleaching of crude montan wax (cf., for example, Ullmann's Encyclopedia of Industrial Chemistry, 5th edition, 1996, vol. A 28, pp. 122-150).

Methods of preparing the compounds which can be used according to the invention are reported in EP-0 291 872 A1.

Photo toners generally comprise resins based on polyesters or styrene-acrylate copolymers as base components. As charge control agents, which aid the transport of the toner from the photo roller onto the paper substrate, use is made of, for example, quaternary ammonium salts for a positive charge and, for example, aluminum-azo complexes for a negative charge of the toner powder. To aid powder flow, small amounts of finely divided silicas can be added to the toner powder.

Depending on the desired color, suitable black or colored pigments are added in the thermoplastic mixture of the toners.

EXAMPLES

The acid numbers reported below were determined in accordance with DIN 53402, and the dropping points were determined in accordance with DIN 51801/2.

Example 1

90 parts by weight of styrene-acrylate resin (type CPR 100, manufactured by Mitsui; glass transition temperature 60° C.; MFR/140° C. 5 g/10 min) were homogeneously mixed with 4 parts by weight of a black pigment (carbon black having a particle size of 2 μm; manufacturer: Timcal), 1.0 parts by weight of a charge control agent (Copy Charge N4S, manufacturer: Clariant GmbH) and 4 parts by weight of a reaction product used according to the invention of technical-grade montanic acid and benzyl alcohol having an acid number of 25 and a dropping point of 77° C. at 150° C. in a kneader. This mixture was then comminuted to give a toner powder having a mean particle size of 12 μm (100%<20 μm). 0.5 parts by weight of a silica-based flow improver (type HDK, manufacturer: Wacker) were then added to the toner powder. 5 g of this now free-flowing mixture were mixed with 95 g of iron powder and placed in the reservoir of a copier.

Toner powder was applied in an area of 20×100 mm to a sheet of paper by means of the photomagnetic roller in the copier. This image was then fixed by means of a roller assembly comprising a rigid heatable roller and an elastic cold roller, at 160° C. and a linear speed of 150 mm/s. A further white sheet of paper was subsequently passed through the hot pair of rollers and was examined for toner residues. No "ghost pictures" could be seen on the white sheet of paper.

Example 2

1 g of the toner powder from example 1 was stirred with 2 g of ethanol and applied by means of a doctor blade to a paper substrate (layer thickness: 40 μm). After the solvent had been dried off at 40° C., the remaining powder layer was fixed at 140° C. and a linear velocity of 120 mm/s. The fixed toner layer was examined by means of a Prufban rubbing-off test as is used in the testing of printing inks. No measurable abraded material was found when the paper was rubbed against toner for 50 strokes. When the toner layer was folded through 180°, no visible fold lines and flaking were found.

Example 3

The procedure of example 1 was repeated, but a reaction product which can be used according to the invention of technical-grade montanic acid and styrene oxide (acid number 18 mg KOH/g, dropping point 76° C.) was used in place of the benzyl montanate wax used in example 1. At the same time, the proportion of pigment was reduced by 25%. Otherwise, the procedure was as in example 1. The printed images displayed the same depth of shade as a standard without wax tested in parallel in the manner described in example 1. This indicates that the addition of wax achieves more effective pigment dispersion.

The invention claimed is:

1. A photo toner comprising at least one pigment component, a resin component and a wax-like compound of the formula (I):

(I)

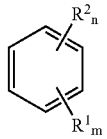

where $R^1$ is the group $—CH_2—O—CO—R^3$ or $—CH(OH)—CH_2—O—CO—R^3$, $R^2$ is an alkyl radical having from 1 to 4 carbon atoms or halogen, $R^3$ is an unbranched alkyl radical having from 16 to 36 carbon atoms and m is 1, 2 or 3 and n is from 0 to (6−m).

2. The photo toner as claimed in claim 1, wherein $R^1$ is the group $—CH_{2—O—CO—R}{}^3$, $R^2$ is an alkyl radical having from 1 to 4 carbon atoms or halogen, $R^3$ is an unbranched alkyl radical having from 16 to 36 carbon atoms and m is 1, 2 or 3 and n is from 0 to (6−m).

3. A photo toner comprising at least one pigment component, a resin component and wax-like compounds of the formula (I):

(I)

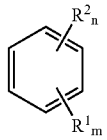

where $R^1$ is the group $—CH_2—O—CO—R^3$ or $—CH(OH)—CH_2—O—CO—R^3$, $R^2$ is an alkyl radical having from 1 to 4 carbon atoms or halogen, $R^3$ is an unbranched alkyl radical having from 16 to 36 carbon atoms and m is 1, 2 or 3 and n is from 0 to (6−m).

4. The photo toner as claimed in claim 3, wherein $R^1$ is the group $—CH_2—O—CO—R^3$, $R^2$ is an alkyl radical having from 1 to 4 carbon atoms or halogen, $R^3$ is an unbranched alkyl radical having from 16 to 36 carbon atoms and m is 1, 2 or 3 and n is from 0 to (6−m).

* * * * *